US010499721B2

(12) United States Patent
Lucero

(10) Patent No.: US 10,499,721 B2
(45) Date of Patent: Dec. 10, 2019

(54) HAIR EXTENSION ORGANIZER AND STORAGE CASE

(71) Applicant: Celeste Ruth Lucero, Wheat Ridge, CO (US)

(72) Inventor: Celeste Ruth Lucero, Wheat Ridge, CO (US)

( * ) Notice: Subject to any disclaimer, the term of this patent is extended or adjusted under 35 U.S.C. 154(b) by 34 days.

(21) Appl. No.: 15/953,495

(22) Filed: Apr. 15, 2018

(65) Prior Publication Data

US 2019/0313772 A1 Oct. 17, 2019

(51) Int. Cl.
*A45D 44/00* (2006.01)
*A41G 5/00* (2006.01)

(52) U.S. Cl.
CPC ..... *A45D 44/00* (2013.01); *A41G 5/004* (2013.01)

(58) Field of Classification Search
CPC ..... A45D 44/00; A45D 44/02; A45D 44/04; A45D 2024/002; A61B 17/06061; A47F 7/065; A41G 5/0086; A41G 5/0073; A41G 5/004; B65D 43/16; B65D 77/322; B65D 81/075
USPC ... 206/459.5, 485, 477, 482, 495, 63.3, 388, 206/755
See application file for complete search history.

(56) References Cited

U.S. PATENT DOCUMENTS

| | | | | |
|---|---|---|---|---|
| 7,798,332 | B1 * | 9/2010 | Brunet | A61M 16/0666 206/364 |
| 8,998,002 | B1 | 4/2015 | Milner | |
| 9,332,820 | B2 | 5/2016 | Bernard | |
| 2012/0181054 | A1 * | 7/2012 | Melton | H02G 3/083 174/50 |
| 2013/0104922 | A1 | 5/2013 | Hall | |
| 2013/0133681 | A1 | 5/2013 | Chipman | |
| 2016/0309882 | A1 | 11/2016 | Abramyan | |
| 2016/0316894 | A1 | 11/2016 | Smith | |

* cited by examiner

*Primary Examiner* — Anthony D Stashick
*Assistant Examiner* — L E Kmet
(74) *Attorney, Agent, or Firm* — Vincent Joseph Wegher

(57) ABSTRACT

The proposed invention is uniquely configured to allow for the efficient organization, storage and use of hair extensions in a salon setting where it can easily fit into a typical salon work station or cart. The two-piece book design allows for ease of operation and transport as well as the stacking of multiple cases. The specialized cut-out sections in each end of invention facilitate direct access to the attachable end of a hair extension and allow for the storage of longer hair extensions when the invention is closed. The vertical pin arrangement on the interior of the invention prevents damage to the hair extensions and keeps them organized, lying flat and separated. These design elements help the stylist to stay organized and work quickly and efficiently. Because the invention can be easily cleaned and sanitized, it can be manufactured to meet most, if not all, state cosmetology sanitation codes.

16 Claims, 6 Drawing Sheets

HAIR EXTENSION ORGANIZER AND STORAGE CASE

CROSS-REFERENCE TO RELATED APPLICATIONS

Not Applicable

STATEMENT REGARDING FEDERALLY SPONSORED RESEARCH OR DEVELOPMENT

Not Applicable

NAMES OF PARTIES TO JOINT RESEARCH AGREEMENT

Not Applicable

STATEMENT REGARDING PRIOR DISCLOSURES BY THE INVENTOR OR A JOINT INVENTOR

Not Applicable

BACKGROUND OF THE INVENTION

Field of the Invention

The present invention was created to help supplement the beauty/hair styling industry in the field of specially adapted hairdressing equipment. Specifically, the invention pertains to hair extension application, organization and storage in a salon or other hairdressing setting. The Hair Extension Organizer and Storage Case is a hair extension organizer and storage case comprised of two hinged covers with an interior space for holding the hair extensions, which, when placed in the case can extend out the ends of the case. The interior may be configured to contain a plurality of small pins that hold and store hair extensions in place without damaging or tangling them.

Description of Related Art

Hair extensions are human or artificial hair, that come in varying lengths, colors and textures that are used to enhance, lengthen or add color to a person's natural hair. When using hair extensions, a new look, style or color can be created to blend naturally with a person's existing hair; for example, blonde highlights can be applied to black or brown hair.

Hair extensions may come in various forms, including but not limited to: strand-by-strand applications, which consist of strands of human hair held together by either glue, wax, silicone or a keratin tip designed to attach to a person's natural hair; and weft hair, which is hair that is attached to a long strip of material which is cut to size as needed and attached to a person's natural hair.

When a stylist is working with hair extensions, such as those described above, the hair can easily become tangled and disorganized, which is a frustrating problem that may cause damage to the hair extension and can become time consuming and costly to remedy.

Thus, when working with hair extensions in a salon or other setting, it is vital for a stylist to have some convenient and easy way (such as a hair extension organizer/storage case) to protect and effectively store the extensions in an organized fashion until they are needed. Presently, the primary means of doing this is either to lay the hair extensions down on a table or countertop or to use a complicated multi-piece and/or tiered hair extensions rack or stand.

Laying unrestrained extensions on a flat surface is problematic because they can easily become disorganized and fall onto the floor. Racks and stands are also a problem because they tend to be cumbersome, are not generally transportable and can be difficult to sanitize. In addition, the inherent complexity of such racks and stands makes them expensive to manufacture and impractical and/or unaffordable for many hairdressers and salons to use.

The deficiencies and problems found in the above-described methods and equipment currently being utilized by hairdressers when handling hair extensions during the application process reveal a present need within the industry for a new hair extension organizer and storage device that is affordable, easy to use and transportable.

Brief Summary of the Invention

The current available technology for organizing and holding hair extensions during the application process is inherently problematic in that it may damage the hair extension, can be cumbersome, and in some instances, is expensive to use.

The Hair Extension Organizer and Storage Case herein is targeted to address such issues as they relate primarily (but not exclusively) to strand-by-strand hair extension applications and can be specifically described as an easy to use and affordable organization and storage case having two covers of the same size and shape that are hinged together so that they open and close like a book.

One embodiment of the Hair Extension Organizer and Storage Case comprises a case made of molded plastic made up of two rectangular covers of the same size and connected on one side by a continuous hinge held together by a removable metal pin.

To facilitate ease of use, the case, when closed, is configured to have an opening at each end, which is intended to permit the hair extension strands, when placed in the case, to hang out of the end the case. This feature in turn allows the stylist to effortlessly access the hair extension strands as they are needed for application to a person's natural hair without having to open the case.

At the same time, a matrix of elongated conical or other shaped pins, which are part of the molded interior face of each cover of the case holds the hair portion of each extension strand in place so that the stylist can easily remove individual hair extension strands without disturbing or damaging extensions that remain in the case.

The removable pin hinge design of the hair extension organizer and storage case permits it to be easily disassembled and sanitized as needed. The plastic molded covers can also be configured with nesting feet that allow for multiple hair extension organizers to be stacked on top of each other; addressing the need for space saving in a salon setting.

The compact and simple configuration of the case allows it to be easily, used, transported and cleaned by the hairdresser. The case will also be less expensive to manufacture, as compared to currently available equipment, because it has very few individual parts (between 3 and 5 depending on the specific embodiment elected) and is easy to assemble. Forming the case out of molded plastic also makes it economical to mass produce. The case, however, can also be cast out of metal.

BRIEF DESCRIPTION OF DRAWINGS

The present invention will be better understood after the review of the following accompanying numbered figures, which are provided for illustrative purposes and not intended to be limiting upon the scope of the present invention and its different embodiments that are further described via the invention's claims and overall specification thereto.

DRAWING—REFERENCE NUMERALS

Figure 1:
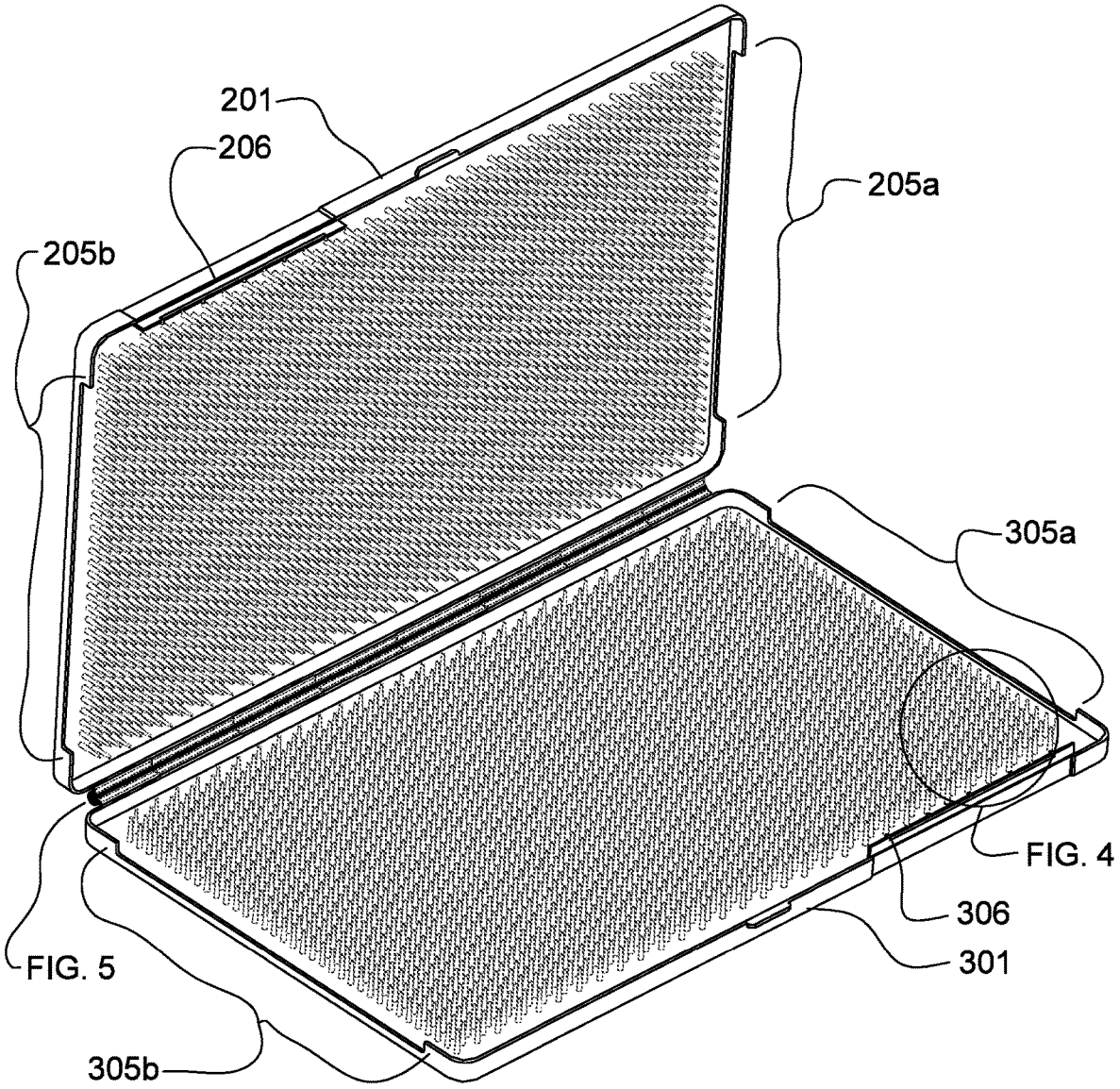
FIG. 1 is an isometric view of the Hair Extension Organizer and Storage Case in an open position.

201 top cover
202*a* top cover tab
203 top cover indention for label
204 concave indentation—typical
205*a* & 205*b* top cover cut-out sections
206 top cover snap-fit latching mechanism
301 bottom cover
302*a* bottom cover tab
303 bottom cover indention for label
304 convex foot bump—typical
305*a* & 305*b* bottom cover cut-out sections
306 bottom cover snap-fit latching mechanism
401 plurality of pins
402 hair extension strand—demonstrative
501 hinge pin
502 top cover hinge knuckle
503 bottom cover hinge knuckle
601 flat top cover—alternative embodiment
602 bottom cover—alternative embodiment
605*a* & 605*b* bottom cover cut-out sections

DETAILED DESCRIPTION OF THE INVENTION

FIG. 1 shows an isometric view of the Hair Extension Organizer and Storage Case (the "Case") in an open position wherein the top cover of the Case 201 is in a vertical position and the bottom cover of the Case 301 is in a horizontal position. The top cover 201 and bottom cover 301 are joined together, see FIG. 5, utilizing a hinge mechanism 501, which allows the user to open the Case like a book. When the Case is fully opened, both the top cover and the bottom cover of the Case will be in a horizontal position allowing the Case to lay flat on a countertop or table. Although a Case that is generally rectangular in shape is depicted, the Case itself could be any number of other shapes such as circular, elliptical or rhomboid.

Figure 4:
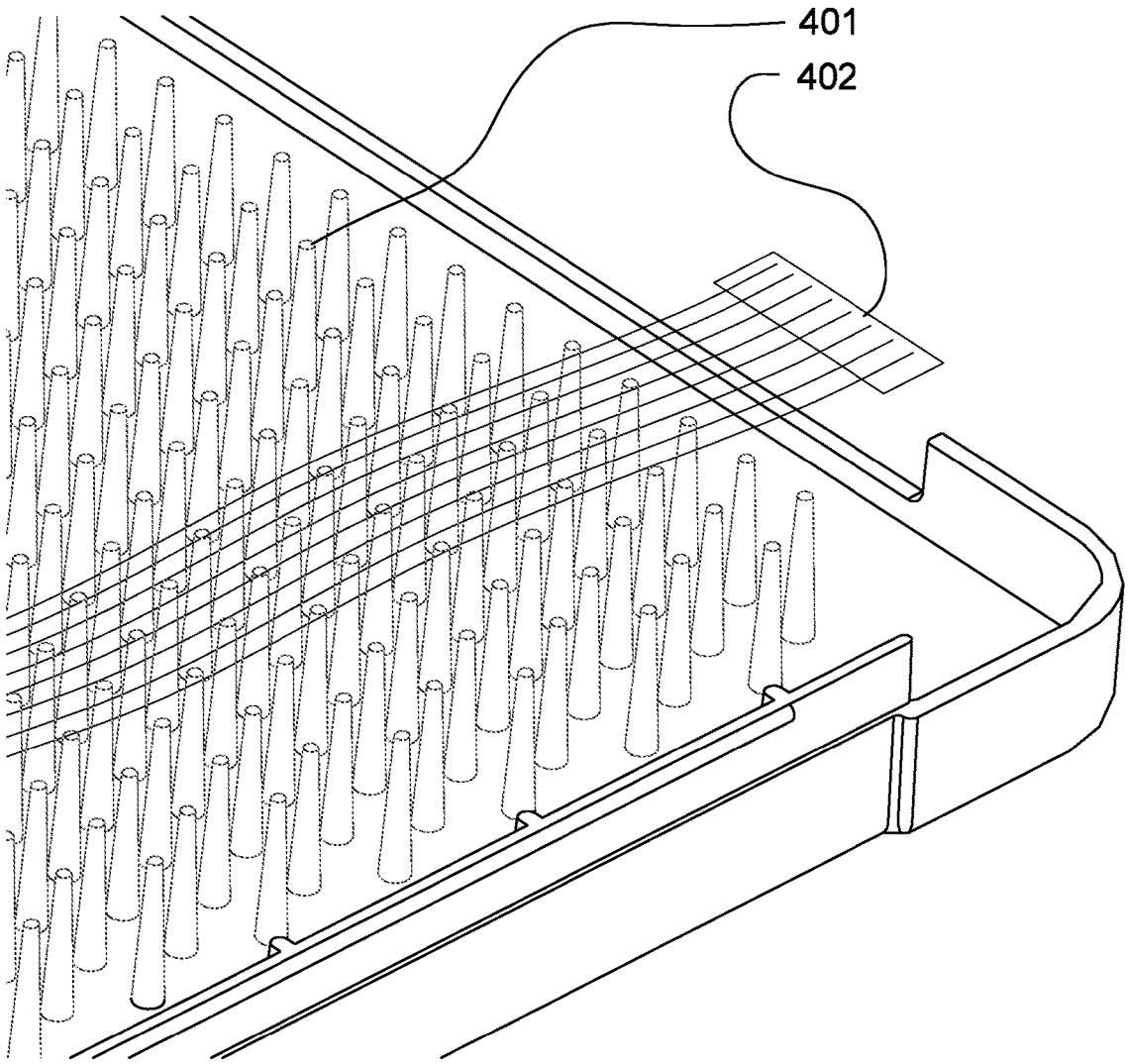
FIG. 4 is a detailed view of one embodiment of a typical portion of the interior of the Hair Extension Organizer and Storage Case.

While the Case is in the open position, hair extension strands 402 may be placed within the interior of the bottom cover, see FIG. 4, in an orientation that is parallel to the Case hinge and with the attachment end of the hair extension strand extending out of the bottom cover through a cut-out section 305*a* found in the lateral end of the bottom cover. If the total length of any hair extension strand is longer than that of the Case itself, the non-attachment end of the hair extension strand may likewise be extended out of opposite lateral end of the bottom cover through a cut-out section 305*b* found there. The top cover of the Case 201 also allows for hair extension strands 402 to extend out of each lateral end of the case through cut-out sections 205*a* and 205*b*. Although a Case with a singular cut-out sections of a rectangular shape is depicted, said cut-outs could be shaped differently and could also be more numerous. The Case could also be configured such that only the bottom cover has cut-outs and the top cover is flat.

Each hair extension strand 402 placed in the bottom cover of the Case by the user is held in place within the bottom cover by a plurality of pins 401 extending from the interior surface of the bottom cover 301. That is to say, if hair extension strands are place in the bottom cover, while it is in the horizontal position, as shown in FIG. 4, the pins found on the interior of the bottom cover will be utilized to hold the hair extension strands in place while the top cover remains open. Although a Case with conical pins is depicted, said pins could be cylindrical in shape as well.

When the user has finished placing hair extension strands 402 in the case, as described above, the top cover of Case 201 may be repositioned over the bottom cover 301 utilizing a hinge mechanism 501 and thereafter, secured in the closed position via two elongated snap-fit type latching mechanisms 206 and 306 that are integrated into partial lengths of the perimeter edge walls of the top and bottom covers opposite of the hinge. Although a Case with an elongated snap-fit type latch is depicted, other types of latches could also be utilized.

Once the Case is secured in a closed position, the hair extension strands 402 contained within will continue to be held in place by the plurality of pins extending from the interior surfaces of the covers. The Case and hair extension strands held within may now be transported by the user without disrupting, tangling or disturbing the original placement of hair extension strands.

Thereafter, the user can gain full access to the hair extension strands held securely within the Case by pulling the Case open via the application of equal amounts of upward and downward pressure to a grouping of two flat tabs 202*a* and 302*a* found protruding at ninety-degree angles from the exterior of the perimeter edge walls of the top and bottom covers that are opposite of the hinge.

Figure 5:
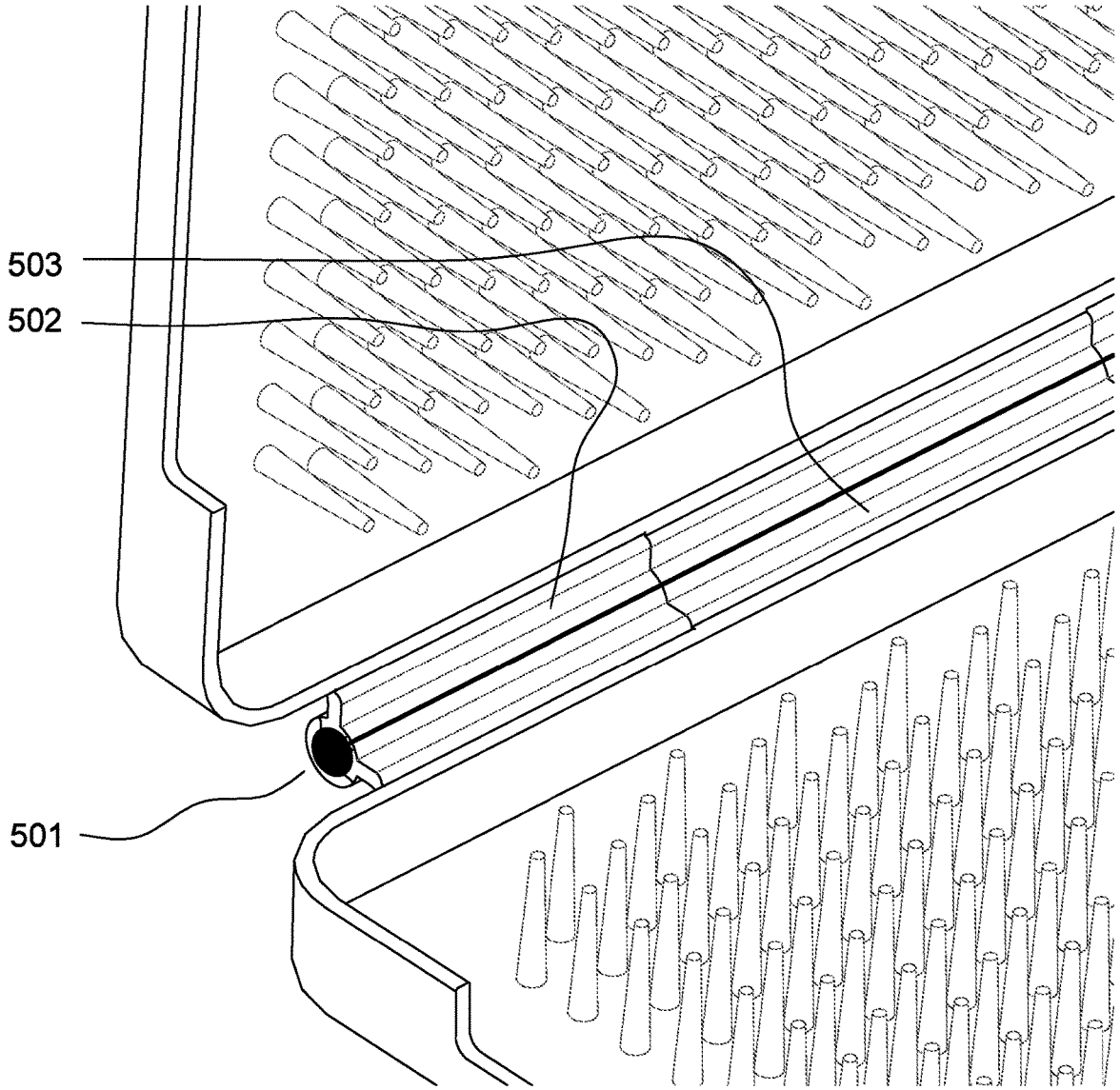
FIG. 5 is a detailed view of one embodiment of the Hair Extension Organizer and Storage Case's hinge mechanism.

The hinge mechanism FIG. 5 utilized by the Case is similar in configuration to a standard piano hinge wherein the knuckles 502 and 503 of hinge are attached in an alternating pattern to the exterior of the top and bottom covers. The hinge pin 501 is also configured to be removable so as to facilitate the disassembly and the cleaning of the Case by the user. Although a Case with a standard piano hinge is depicted, other types of hinges could also be utilized.

Figure 3:
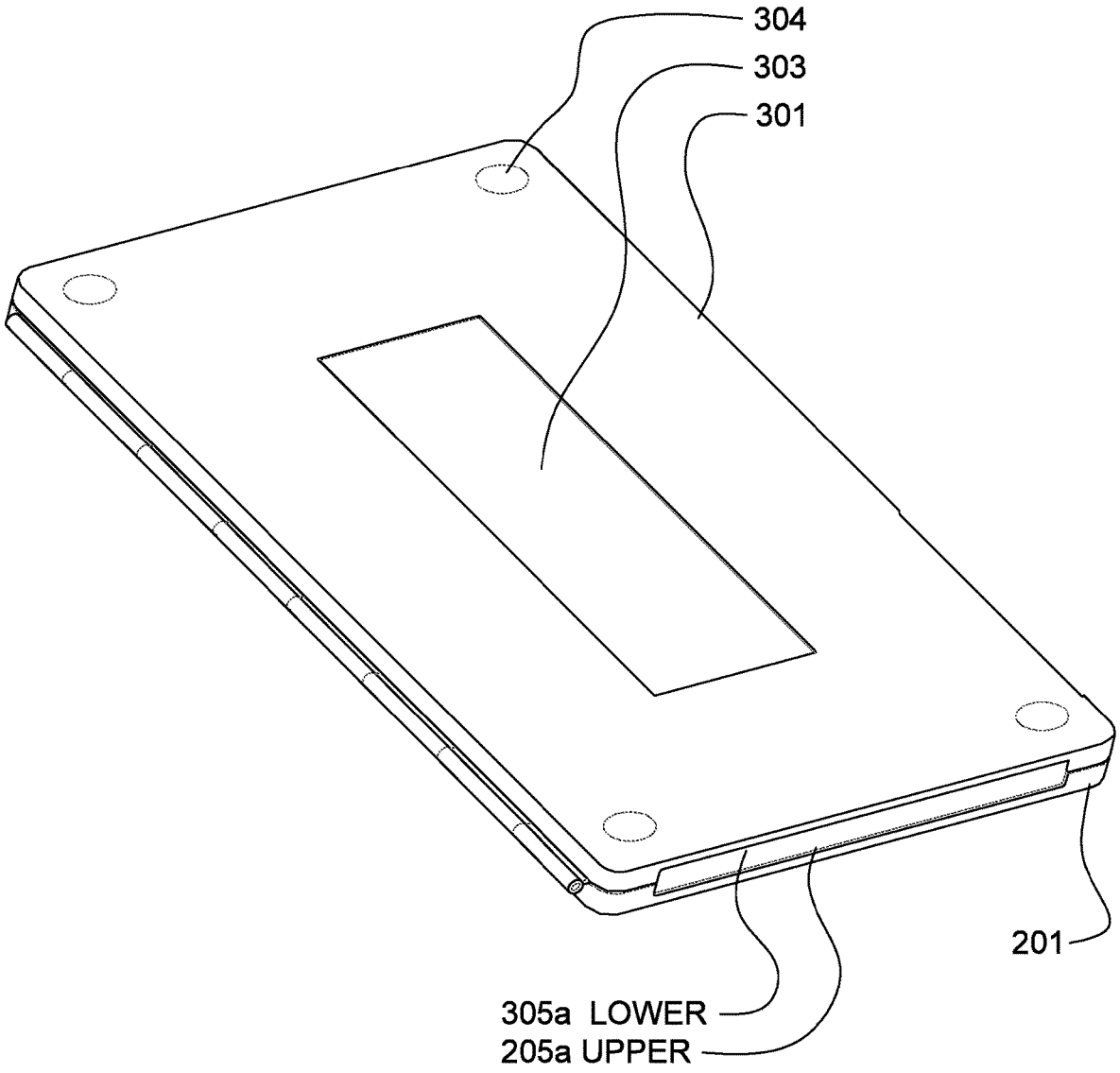
FIG. 3 is an isometric view of the bottom of the Hair Extension Organizer and Storage Case in the closed position.

FIG. 3 shows an isometric view of the exterior of the bottom cover 301 in the closed position. Located in the area approximate to each corner of the bottom cover 301 is one of a total of four semi-spherical convex foot bumps 304. When the Case is placed on a flat surface such as a table or counter-top, the foot bumps serve to position the flat exterior portion of the bottom cover just above the surface of said table or counter-top. This creates an air gap between the flat exterior portion of the bottom cover and the surface of the table or counter top upon which the Case rests. This air gap prevents the Case from becoming suctioned onto the surface of said table or counter-top when that surface is wet or otherwise covered with any tacky liquid or substance.

Figure 2:
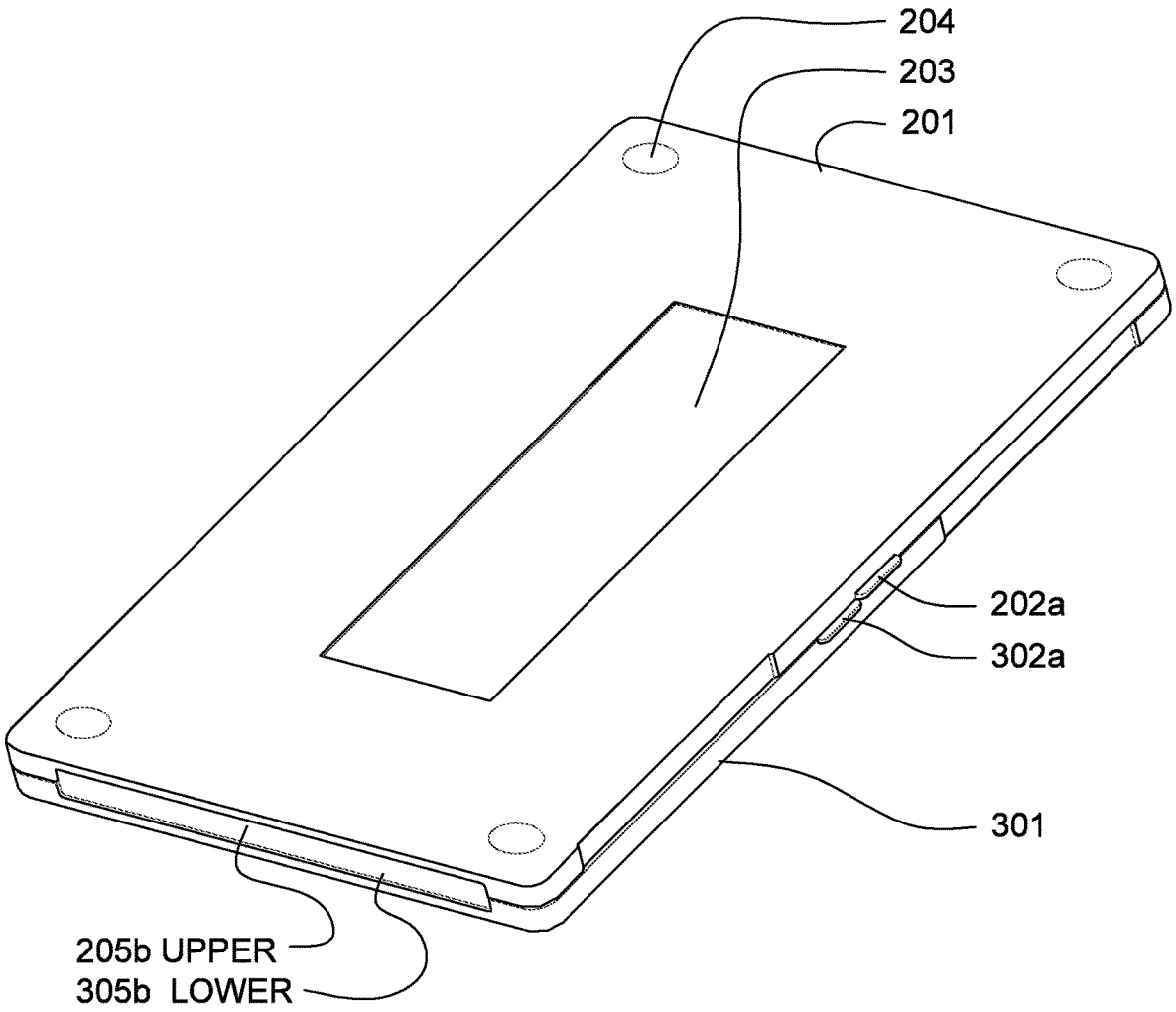
FIG. 2 is an isometric top view of the Hair Extension Organizer and Storage Case in the closed position.

This configuration of foot bumps on the exterior of the bottom cover, see FIG. 3, also allows the user to stack more than one Case upon another by aligning the foot bumps up with a matching set of concave semi-spherical indentations 204 set approximate to each of the corner areas of the exterior surface of the top cover, see FIG. 2. The nesting of the convex foot bumps 304 into the concave indentations 204, when one or more Cases are stacked, keeps the Cases in alignment with respect to each other while they are resting on a table or counter-top or are being transported by the user. Although a Case with four semi-spherical foots bumps and matching indents is depicted, said foot bumps and indents could be any shape and could be more numerous than four.

FIG. 2 and FIG. 3 also depict rectangular indentations 203 and 303 in the exterior surfaces of the top and bottom covers, these indentations allow the user to place a label and/or logo sticker onto each individual Case. Although a Case with rectangular indentations is depicted, said indentation could be any shape and more numerous than one.

Figure 6:
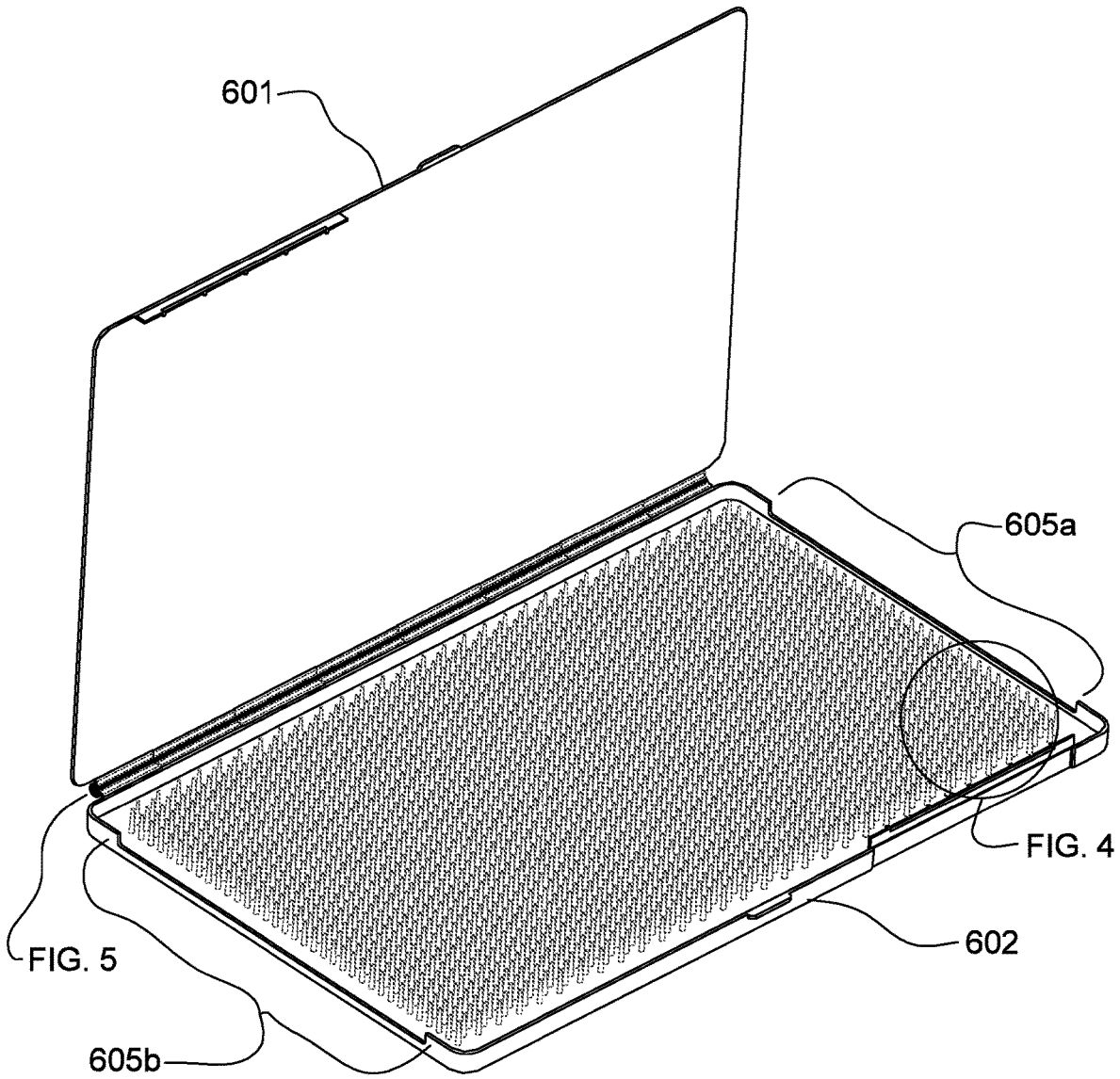
FIG. 6 is an isometric view of the Hair Extension Organizer and Storage Case in the open position depicting an alternative embodiment of the invention wherein the top cover is flat.

FIG. 6 shows an isometric view of an alternative embodiment of the Hair Extension Organizer and Storage Case in an open position wherein the top flat shaped cover of the Case 601 is in a vertical position and the bottom box shaped cover of the Case 602 is in a horizontal position. The top cover 601 and bottom cover 602 are joined together, utilizing a hinge mechanism as depicted in FIG. 5, which allows the user to open the Case like a book. Although a Case that is generally rectangular in shape is depicted, the Case itself could be any number of other shapes such as circular, elliptical or rhomboid.

I claim:

1. A hair extension organizer and storage case, comprising:

a bottom cover with raised perimeter edge walls, a top cover with raised perimeter edge walls, wherein said covers are hinged together by a hinging mechanism along the length of one of the perimeter edge walls of the bottom cover and the top cover, wherein the raised perimeter edge walls of said covers that are lateral to the hinged side of the covers each contain a cut-out section of the raised perimeter edge wall such that when the case is closed hair extensions place inside the case can extend out of each of the said cut-out sections, wherein the bottom cover contains a plurality of equal length pins attached in a perpendicular orientation to the interior surface of said bottom cover, and said plurality is arranged in a pattern that covers a majority of the area of the interior surface of said bottom cover, and the top cover contains a plurality of equal length pins attached in a perpendicular orientation to the interior surface of said top cover, wherein said plurality is arranged in a pattern that covers a majority of the area of the interior surface of said top cover.

2. The hair extension organizer and storage case of claim 1, wherein the length of said of pins is equal in height to that of the interior of the perimeter edge walls of said bottom and top covers respectively.

3. The hair extension organizer and storage case of claim 1, wherein the length of said of pins in the bottom cover and the top cover is longer in height than that of the interior of the perimeter edge walls of said bottom and top covers, and said pins are arranged so that the bottom cover pins and top cover pins do not touch one another when the Case is closed.

4. The hair extension organizer and storage case of claim 1, wherein only said bottom cover has a plurality of pins attached in a perpendicular orientation to the interior surface of said bottom cover with said pins being equal in length to the just under the combined height of the interior of the perimeter edge walls of said bottom and top covers.

5. A hair extension organizer and storage case, comprising:

a bottom cover with raised perimeter edge walls, a top cover that lacks perimeter edge walls and is instead flat, wherein said covers are hinged together by a hinging mechanism along the length of one of the perimeter edge walls of the bottom cover and the flat edge of the top cover, wherein the raised perimeter edge walls of said bottom cover that are lateral to the hinged side of the bottom cover each contain a cut-out section of the raised perimeter edge wall such that when the case is closed hair extensions place inside the bottom cover of the case can extend out of each of the said cut-out sections in the bottom cover, wherein said bottom cover has a plurality of equal length pins with said pins being equal in length to the height of the interior of the perimeter edge walls of said bottom cover, and wherein the plurality of equal length pins is attached in a perpendicular orientation to the interior surface of said bottom cover, and said plurality is arranged in a pattern that covers a majority of the area of the interior surface of said bottom cover.

6. The hair extension organizer and storage case as in either claim 1 or claim 5, wherein said pins are conical in shape.

7. The hair extension organizer and storage case as in either claim 1 or claim 5, wherein said pins are cylindrical in shape.

8. The hair extension organizer and storage case as in either claim 1 or claim 5, wherein said hinging mechanism is configured so that bottom and top covers may be easily unhinged from each other and then easily re-hinged.

9. The hair extension organizer and storage case as in claim 1 or claim 5, further including a set of concave indents in the exterior surface of the top cover, a set of convex foot bumps on the exterior surface of the bottom cover, wherein the indents and the foot bumps are similar in shape and size so as to permit the foot bumps to nest within the indents when one or more of said cases are stacked.

10. The hair extension organizer and storage case as in either claim 1 or claim 5, further including shallow indentations in the exterior surfaces of the top and bottom covers, such that said indentations would allow the user to place a label and/or logo sticker in the indented area of the top and/or bottom covers of said case.

11. The hair extension organizer and storage case as in either claim 1 or claim 5, further including a removable metal hinge pin to facilitate the unhinging and re-hinging of said hinging mechanism.

12. The hair extension organizer and storage case as in either claim 1 or claim 5, further including a latching mechanism located somewhere on the perimeter edge of said covers that is designed to keep the case secured and shut in the closed position when desired.

13. The hair extension organizer and storage case as in claim 1 or claim 5, further including a latching mechanism wherein said latching mechanism located on the exterior perimeter edge of said covers that is opposite of the hinged side of the covers and that is designed to keep the case secured and shut in the closed position when desired.

14. The hair extension organizer and storage case of claim 1, wherein the cut-out section of the perimeter edge walls forms the general shape of rectangle when the case is closed.

15. The hair extension organizer and storage case of claim 1, wherein the cut-out section of the perimeter edge walls forms the general shape of rectangle with radius corners when the case is closed.

16. The hair extension organizer and storage case, as in either claim 1 or claim 5, wherein said case is made of molded plastic or cast metal.

* * * * *